United States Patent [19]

Norton et al.

[11] Patent Number: 4,541,837

[45] **Date of Patent: * Sep. 17, 1985**

[54] FUELS

[75] Inventors: John H. R. Norton, Johannesburg; Peter R. Rebello, Edenvale; Clifford M. Kavonic, Bedfordview; Anthony J. Stiff, Edenvale, all of South Africa

[73] Assignee: AECI Limited, Johannesburg, South Africa

[ * ] Notice: The portion of the term of this patent subsequent to Sep. 17, 2002 has been disclaimed.

[21] Appl. No.: 207,616

[22] Filed: Nov. 17, 1980

[30] Foreign Application Priority Data

| | | | |
|---|---|---|---|
| Dec. 11, 1979 | [ZA] | South Africa | 79/6717 |
| Aug. 28, 1980 | [ZA] | South Africa | 80/5348 |
| Sep. 25, 1980 | [ZA] | South Africa | 80/5954 |

[51] Int. Cl.[4] ..... C10L 1/18; C10L 1/22

[52] U.S. Cl. ..... 44/53; 44/63; 44/71

[58] Field of Search ..... 44/53, 63, 71, 77

[56] References Cited

U.S. PATENT DOCUMENTS

| | | | |
|---|---|---|---|
| 1,582,420 | 4/1926 | Nikaido | 44/57 |
| 2,265,196 | 12/1941 | Riley | 44/77 |
| 2,378,466 | 6/1945 | Curme, Jr. | 44/57 |
| 2,673,793 | 3/1954 | Brodhacker | 44/57 |
| 2,800,400 | 7/1957 | Hughes | 44/77 |
| 2,847,292 | 8/1958 | Hager et al. | 44/53 |
| 2,991,254 | 7/1961 | Oberdorfer, Jr. | 44/53 |
| 4,081,252 | 3/1978 | Osborg | 44/53 |
| 4,191,536 | 3/1980 | Niebylski | 44/63 |
| 4,198,931 | 4/1980 | Malec | 44/57 |

FOREIGN PATENT DOCUMENTS

| | | | |
|---|---|---|---|
| 238693 | 11/1945 | Sweden | 44/56 |

OTHER PUBLICATIONS

English Translation of Brazilian Patent Application P17700392.

*Primary Examiner*—Jacqueline V. Howard

*Attorney, Agent, or Firm*—Cushman, Darby & Cushman

[57] ABSTRACT

The invention concerns a fuel comprising a mixture of (A) at least one alcohol with an average molecular weight of less than 160, and (B) at least one further organic compound which has a spontaneous ignition temperature of less than 450° C. The further organic compound is (1) a compound which contains one or more oxygen atoms but no nitrogen atoms, with the proviso that, (1.1) the compound is not a dialkoxy compound of formula

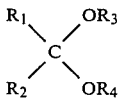

in which $R_1$ and $R_2$ indicate hydrogen or straight-chain or branched alkyl radicals with up to 4 C-atoms, and $R_3$ and $R_4$ are straight-chain or branched alkyl radicals with up to 4 C-atoms; or (2) a compound which contains one or more nitrate groups and one or more ether linkages, or (3) a nitrogen-containing organic compound selected from the group consisting of azo compounds, tetrazines, nitroso compounds, nitro compounds, nitrates, and hyponitrites, with the proviso that component (B) is not entirely a linear or branched-chain alkyl nitrate containing between 2 and 8 carbon atoms.

There are the provisos that, when the alcohol is methanol, the component (B) is not (a) a polyether of the general formula $R[O(A)_nH]m$ wherein R represents hydrogen or a residue of an organic compound, which is built up of hydrogen and carbon and optionally oxygen and which has from 1 to 12 hydrogen atoms, which can be reacted with ethylene oxide or propylene oxide; A represents independently of each other a group derived from ethylene oxide or propylene oxide; m is a number from 1–12, and n has such a value that the total number of units derived from ethylene oxide and/or propylene oxide is 4–400, and is not (b) a polyether soluble in methanol and which contains 4–400 oxyalkylene units, derived from ethylene oxide and/or propylene oxide, wherein said oxyalkylene units constitute at least 40 percent by weight of the polyether.

2 Claims, No Drawings

FUELS

This invention relates to fuels, in particular fuels for compression ignition engines.

The use of methanol as a fuel suffers from the drawback that we are not aware of it being able to be used on its own in conventional compression ignition engines, commonly know as diesel engines. On the other hand, it would be desirable to utilise methanol as a fuel since it can be obtained from coal, of which there are large resources in many Western countries, particularly in the Republic of South Africa.

The use of ethanol as a fuel has recently become of great interest in view of the high cost of fuels from oil.

In one aspect the present invention provides a fuel comprising a mixture of (A) at least one alcohol with an average molecular weight of less than 160, and (B) at least one further organic compound or mixture of organic compounds which together have a spontaneous ignition temperature of less than 450° C., said further organic compound or mixture being one or more of:

(1) a compound which contains one or more oxygen atoms but no nitrogen atoms, with the proviso that:

(1.1) the compound is not a dialkoxy compound of formula

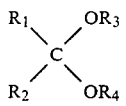

in which $R_1$ and $R_2$ indicate hydrogen or straight-chain or branched alkyl radicals with up to 4 C-atoms, and $R_3$ and $R_4$ are straight-chain or branched alkyl radicals with up to 4 C-atoms; and with the proviso that:

(1.2) when the alcohol is methanol, the component (B) is not (1.2.1) a polyether of the general formula $R[O(A)_nH]m$ wherein R represents hydrogen or a residue of an organic compound, which is built up of hydrogen and carbon and optionally oxygen and which has from 1 to 12 hydrogen atoms, which can be reacted with ethylene oxide or propylene oxide; A represents independently of each other a group derived from ethylene oxide or propylene oxide; m is a number from 1–12, and n has such a value that the total number of units derived from ethylene oxide and/or propylene oxide is 4–400, and is not (1.2.2) a polyether soluble in methanol and which contains 4–400 oxyalkylene units derived from ethylene oxide and/or propylene oxide, wherein said oxyalkylene units constitute at least 40 percent by weight of the polyether, or (2) a compound which contains one or more nitrate groups and one or more ether linkages, (an ether linkage being an oxygen atom linking two carbon atoms), or (3) a nitrogen-containing organic compound selected from the group consisting of azo compounds, tetrazines, nitroso compounds, nitro compounds, nitrate compounds, and hyponitrites, with the proviso that component (B) is not entirely a linear or branched-chain alkyl nitrate containing between 2 and 8 carbon atoms.

In a second aspect the invention also provides a method of running an engine, which comprises injecting and/or inducting into the engine both (A) at least one alcohol with a molecular weight of less than 160 and (B) at least one further organic compound or mixture of organic compounds which together have a spontaneous ignition temperature of less than 450° C., said further organic compound or mixture being one or more of:

(1) a compound which contains one or more oxygen atoms but no nitrogen atoms, with the proviso that:

(1.1) the compound is not a dialkoxy compound of formula

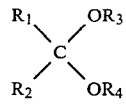

in which $R_1$ and $R_2$ indicate hydrogen or straight-chain or branched alkyl radicals with up to 4 C-atoms, and $R_3$ and $R_4$ are straight-chain or branched alkyl radicals with up to 4 C-atoms; and with the proviso that:

(1.2) when the alcohol is methanol, the component (B) is not (1.2.1) a polyether of the general formula $R[O(A)_nH]m$ wherein R represents hydrogen or a residue of an organic compound, which is built up of hydrogen and carbon and optionally oxygen and which has from 1 to 12 hydrogen atoms, which can be reacted with ethylene oxide or propylene oxide; A represents independently of each other a group derived from ethylene oxide or propylene oxide; m is a number from 1–12, and n has such a value that the total number of units derived from ethylene oxide and/or propylene oxide is 4–400, and is not (1.2.2) a polyether soluble in methanol and which contains 4–400 oxyalkylene units, derived from ethylene oxide and/or propylene oxide, wherein said oxyalkylene units constitute at least 40 percent by weight of the polyether, or (2) a compound which contains one or more nitrate groups and one or more ether linkages, or (3) a nitrogen-containing organic compound selected from the group consisting of azo compounds, tetrazines, nitroso compounds, nitro compounds, nitrate compounds, and hyponitrites, with the proviso that component (B) is not entirely a linear or branched-chain alkyl nitrate containing between 2 and 8 carbon atoms.

The components of the fuel may be injected and/or inducted as a mixture or may be injected and/or inducted separately from separate containers. The engine conveniently can be a compression ignition engine.

We have found that, when mixed with said alcohols, said further organic compounds up-rate the compression-ignition characteristics of said alcohols as compression ignition fuels. Thus these alcohols can be up-rated to form suitable fuels for naturally aspirated commercial compression ignition engines by addition of the further organic compounds, where the alcohols are, without the added organic compounds, either less suitable or unsuitable for use as such fuels. Alcohols up-rated in this way can thus act as fuels in naturally aspirated commercial compression-ignition engines without the need for additional energy inputs and/or aids such as heated air aspiration, turbocharging, spark-ignition, abnormally high compression ratios or other additional energy sources and/or aids, although such additional energy sources and/or aids may be used, if desired. The further organic compounds act, when added in increasing amounts to fuels according to the invention which are barely capable of use in naturally aspirated compression-ignition engines, to increase power output and to cause said engines to run more smoothly.

We have found, in particular, that if the organic compound (B) contains both nitrate groups and ether linkages, these particular compounds are especially suitable as ignition improvers for the alcohol fuel.

The alcohol or mixture of alcohols, forming component (A), conveniently has an average molecular weight of less than 90. Particularly preferred alcohols are methanol and ethanol.

Component (B) is an organic compound or mixture of organic compounds having a spontaneous ignition temperature of less than 450° C. The term 'spontaneous ignition temperature' is understood to mean the lowest temperature at which the material will ignite on its own in air. The organic compounds providing component (B), and which can be mixed with the alcohol, are oxygen-containing organic compounds, and the above defined nitrogen-containing compounds, some of which contain both nitrogen and oxygen atoms.

Examples of oxygen-containing compounds (1) which can be used as component (B) are other alcohols, ethers, peroxides, hydroperoxides, acyl compounds of the formula R—(CO)—R′ (where R and R′ are suitable organic residue but one of which may be hydrogen), cyclic ethers containing one or more oxygen atoms in the ring, and esters. An ether linkage is a linkage where an oxygen atom joins two carbon atoms.

The ether linkages in the oxygen compounds (1) which can be used according to the invention as component (B) may be present in any of the following forms, in which $R_1$ and $R_2$ are alkyl groups each containing 1 to 20 carbon atoms, each of $R_3$, $R_4$, $R_5$ and $R_7$ may be alkyl groups each containing 1 to 20 carbon atoms, or an organic radical containing further ether linkages, and optionally also other functional groups, such as hydroxyl, carbonyl (to include other carbonyl-containing groups such as carboxylic acid, ester, aldehyde or carbonate), azo, and nitro, in particular O-nitro (nitrate) and $R_6$ is H, or any of the radicals represented by $R_3$.

The ethers may be (a) Simple ethers of formula $R_1$—O—$R_2$, for example di-iso-amyl ether where $R_1$ and $R_2$ are —$CH_2CH_2CH(CH_3)_2$.

(b) Alkoxy ethers of formula $R_3$—O—$R_1$ for example 1,2-dibutoxy ethane, where $R_1$ is —$nC_4H_9$, and $R_3$ is —$(CH_2)_2$—O—$nC_4H_9$.

(c) Ethers containing ether linkages between radicals containing further functional groups, of formula $R_3$—O—$R_4$. For example:

(i) diethylene glycol dimethyl ether, where $R_3$ and $R_4$ are —$(CH_2)_2$—O—$CH_3$;

(ii) diethylene glycol monobutyl ether, $nC_4H_9OCH_2CH_2OCH_2CH_2OH$;

(iii) 1,3 dibutoxy-2-propanol,

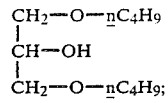

(iv) ethyl 2-butoxyethyl carbonte

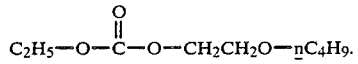

(d) Ethers containing acetal and/or ketal groups, of formula

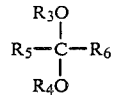

For example:

(i) acetaldehyde dihexyl acetal where $R_3$ and $R_4$ are —$nC_6H_{13}$, $R_5$ is —$CH_3$ and $R_6$ is —H.

(ii) glyoxal tetrabutyl acetal, $(nC_4H_9O)_2CH$—CH-(O—$nC_4H_9)_2$.

(iii) glyoxal tetra-(2-butoxyethyl)acetal $(nC_4H_9OCH_2CH_2O)_2CH$—CH($OCH_2CH_2$O—$nC_4H_9)_2$.

(e) Ethers containing orthoester groups of formula

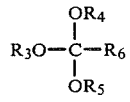

For example:

(i) Triethyl orthoformate, where $R_3$,$R_4$ and $R_5$ are —$C_2H_5$ and $R_6$ is —H (ii) Tributyl orthoacetate, $R_3$,$R_4$ and $R_5$ are —$nC_4H_9$ and $R_6$ is —$CH_3$.

(f) Ethers containing orthocarbonate groups, of formula

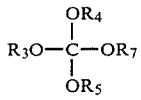

For example: tetrabutyl orthocarbonate $R_3$,$R_4$,$R_5$ and $R_7$ are —$nC_4H_9$.

(g) Cyclic ethers, of formula

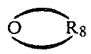

in which $R_8$ may be a hydrocarbon chain containing two or more carbon atoms, or may be an organic radical containing other ether linkages and/or other functional groups as described for radicals $R_3$–$R_7$ above. For example:

(i) tetrahydrofuran, $R_8$ is $-(CH_2)_4$ (ii) Paraldehyde, $R_8$ is

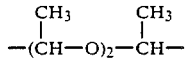

(iii) Furfural, $R_8$ is

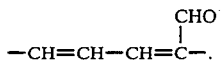

When the component (B) contains a nitrate group and an ether linkage, (i.e. a 'compound 2' above), the ether linkages may be present for example in one or more of the following forms:

(a) simple ether linkages e.g. 2-ethoxyethyl nitrate and 2'-butoxy-2-ethoxy ethyl nitrate
(b) acetal or ketal groups e.g. 2,2-diethoxy ethyl nitrate
(c) ortho ester groups
(d) ortho carbonate groups
(e) cyclic ethers e.g. 1,3-dioxane-5-nitrate.

The nitrogen compounds (3) which can be used as component (B), are azo compounds and tetrazines (including those containing up to two organic residues substituted on each terminal nitrogen atom), as well as the following compounds containing both nitrogen and oxygen atoms, namely nitroso compounds (of Formula $R_9$—NO), nitro compounds (of Formula $R_9$—$NO_2$), nitrate compounds (of Formula $R_9$—$ONO_2$), and hyponitrites (of Formula $R_9$—ON=NO—$R_{10}$). In these formulae the radicals $R_9$ and $R_{10}$ are organic radicals.

The ratios of constituents (A) and (B) can vary widely, e.g. from about 99,9999 to 0,1 parts of alcohol per 100 parts fuel mixture, the balance being the further organic compound, more conveniently 50 to 99% of the alcohol constituent generally is present. If desired, up to about 15% by weight of water may be added.

Particular examples of compounds which can be mixed with methanol and/or ethanol are acetaldehyde, paraldehyde, tetrahydrofuran, nitromethane, propionaldehyde, 2-ethoxy ethyl nitrate, 2-butoxyethyl nitrate, 2'-butoxy-2-ethoxy-ethyl nitrate, diethylene glycol dinitrate, triethylene glycol dinitrate and the dinitrate of polyethylene glycol of an average molecular weight of 400.

When manufacturing a fuel, the fuel may be made by mixing the constituents together. If desired, a lubricant such as castor oil also may be added. Other organic, organometallic or inorganic materials may be added to the fuel, for example lubricants, stabilisers, corrosion inhibitors, ignition improvers, other fuels, fuel extenders and fuel additives.

Fuel may be injected into the engine via the fuel injection system and/or inducted into the engine via the air inlet manifold.

When running an engine on the fuel, the components may be injected and/or inducted as a mixture or may be injected and/or inducted separately from separate containers. If desired, injection may be effected by utilizing an initial small amount, followed subsequently by a larger amount. If desired, diesel fuel may be injected as a mixture with the fuel of the invention or separately therefrom.

The invention is illustrated by reference to the following non-limiting Examples:

EXAMPLE 1

Various fuels were made by mixing together the constituents specified below. The mixture was then inducted into a test compression ignition engine. It was found that in every case ignition took place on compression of the engine. The fuels tested were the following constituents, the percentages being by volume:

25% acetaldehyde and 75% methanol
10% acetaldehyde and 90% methanol
25% acetaldehyde, 74% methanol and 1% castor oil
20% acetaldehyde, 70% methanol and 10% water
20% acetaldehyde and 80% ethanol
25% paraldehyde and 75% methanol
25% tetrahydrofuran and 75% methanol
20% nitromethane and 80% methanol
10% acetaldehyde, 70% methanol and 20% diacetyl
50% 2-butoxyethanol, 50% methanol
50% diethyleneglycol monobutyl ether, 50% methanol
50% dioxan, 50% methanol
50% acetylacetone, 50% methanol

EXAMPLE 2

Various fuels were made by mixing together the constituents specified below. The mixture was then injected into a test compression-ignition engine. It was found that in every case ignition took place on compression of the engine, and the engine ran continuously. The fuels tested were the following constituents, the percentages being by volume:

(i) 50% Diethyl ether, 50% Methanol.
(ii) 40% Di-iso-amyl ether, 60% Methanol.
(iii) 30% Butyl carbitol. (Diethylene glycol monobutyl ether), 70% Methanol.
(iv) 20% Glyoxal tetrabutyl acetal, 80% Methanol.
(v) 20% Glyoxal tetra (2'-butoxyethyl) acetal, 80% Methanol.
(vi) 20% Butyl Carbitol, 10% Triethyl orthoacetate, 70% Methanol.
(vii) 20% Butyl Carbitol, 10% Trimethyl orthoformate, 70% Methanol.
(viii) 10% Butyl Carbitol, 10% Trimethyl Orthoacetate, 70% Methanol.
(ix) 10% Butyl Carbitol, 10% Paraldehyde, 80% Methanol.
(x) 10% Glyoxal tetrahexyl acetal, 10% Paraldehyde, 80% Methanol.
(xi) 20% Diethylene glycol dimethyl ether, 80% Methanol.
(xii) 10% Diethylene glycol dimethyl ether, 10% Paraldehyde, 80% Methanol.
(xiii) 20% 1,3-Dibutoxy-2-propanol, 80% Methanol.
(xiv) 10% 2-Ethoxyethyl nitrate, 90% Methanol.
(xv) 4% 2-Ethoxyethyl nitrate, 96% Methanol.

EXAMPLE 3

Various fuels were made by mixing together the constituents specified below. The mixture was then injected into a test compression ignition engine. It was found that in every case ignition took place on compression of the engine, and the engine ran continuously under load. The fuels tested were the following constituents, the percentages being by volume:

(i) 10% 2-Ethoxyethyl nitrate, 90% Methanol.
(ii) 10% 2-Butoxyethyl nitrate, 90% Methanol.
(iii) 10% 2'-Butoxy-2-ethoxyethyl nitrate, 90% Methanol.
(iv) 10% Diethylene glycol dinitrate, 90% Methanol.
(v) 10% Triethylene glycol dinitrate, 90% Methanol.
(vi) 10% Polyethylene glycol 400 dinitrate, 90% Methanol.
(vii) 4% Triethylene glycol dinitrate, 96% Ethanol.
(viii) 4% Triethylene glycol dinitrate, 96% Isopropanol.
(ix) 1% Triethylene glycol dinitrate, 99% n-Butanol.

(x) 3% Triethylene glycol dinitrate, 97% Iso-amyl alcohol.

(xi) 0.2% Triethylene glycol dinitrate, 99.8% n-Octanol.

(xii) 4% Triethylene glycol dinitrate, 67.2% Ethanol, 25.9% Propanol, 2.4% Butanol, 0.5% Higher alcohols.

(xiii) 1.6% Triethylene glycol dinitrate, 0.8% Methanol, 1.6% Ethanol, 32% Butanol, 16% Pentanol, 32% Octanol, 16% Dodecanol.

(xiv) 5% Triethylene glycol dinitrate, 75% Methanol, 14% Ethanol, 5.4% Propanol, 0.6% Butanol.

(xv) 9% Triethylene glycol dinitrate, 1% Methanol, 90% Acetone.

(xvi) 10% Triethylene glycol dinitrate, 10% Methanol, 80% Methyl formate.

(xvii) 5% Triethylene glycol dinitrate, 80% Methanol, 15% Furfural.

(xviii) 5% Triethylene glycol dinitrate, 80% Methanol, 15% Dimethyl carbonate.

EXAMPLE 4

A fuel comprising 5% triethylene glycol dinitrate, 2% castor oil, and 93% methanol was injected into a 7.45 kw twin-cylinder naturally aspirated diesel engine coupled to an electrical generator. The fuel was found to start the engine from cold (ambient temperature 10° C.) and run the engine satisfactorily at the rated power output.

EXAMPLE 5

A fuel comprising 10% triethylene glycol dinitrate, 2% castor oil and 88% methanol was injected into a 3.5 liter 4-cylinder diesel-engined vehicle, whilst inducting a further quantity of methanol into the engine via the air inlet manifold. Using this fuel the vehicle could be driven satisfactorily.

We claim:

1. A fuel suitable for use in a diesel engine comprising a mixture of (A) methanol or ethanol as the essential fuel component and, as an additive to up-rate the compression-ignition characteristics of the methanol or ethanol as a fuel, (B) at least one further organic compound which has a spontaneous ignition temperature of less than 450° C., said further organic compound being selected from 2'-butoxy-2-ethoxy ethyl nitrate; diethylene glycol dinitrate; triethylene glycol dinitrate, and the dinitrate of polyethylene glycol of an average molecular weight of 400.

2. In a method of running an engine using methanol or ethanol as the fuel, the improvement which comprises injecting and/or inducting into the engine with the alcohol, at least one further organic compound which has a spontaneous ignition temperature of less than 450° C., said further organic compound being selected from 2'-butoxy-2-ethoxy ethyl nitrate; diethylene glycol dinitrate; triethylene glycol dinitrate, and the dinitrate of polyethylene glycol of an average molecular weight of 400.

* * * * *